US011631560B2

(12) United States Patent
Goldman et al.

(10) Patent No.: US 11,631,560 B2
(45) Date of Patent: Apr. 18, 2023

(54) GUIDING PULL RING

(71) Applicant: S&C Electric Company, Chicago, IL (US)

(72) Inventors: David Goldman, Chicago, IL (US); Thomas Fanta, Lake Zurich, IL (US)

(73) Assignee: S&C Electric Company, Chicago, IL (US)

( * ) Notice: Subject to any disclaimer, the term of this patent is extended or adjusted under 35 U.S.C. 154(b) by 0 days.

(21) Appl. No.: 16/848,409

(22) Filed: Apr. 14, 2020

(65) Prior Publication Data

US 2020/0335293 A1 Oct. 22, 2020

Related U.S. Application Data

(60) Provisional application No. 62/835,621, filed on Apr. 18, 2019.

(51) Int. Cl.
*H01H 33/662* (2006.01)
*H01H 33/666* (2006.01)

(52) U.S. Cl.
CPC .... *H01H 33/666* (2013.01); *H01H 33/66207* (2013.01); *H01H 2033/6665* (2013.01)

(58) Field of Classification Search
CPC ..... H01H 33/666; H01H 33/66207; H01H 31/12; H01H 31/006; H01H 31/127; H01H 9/0038; H01H 50/54; H01H 2033/6665; H01H 33/008; H01H 33/127; H01H 75/04; H02H 3/20
USPC ..... 218/139, 12, 11, 10; 174/73.1; 361/71; 335/194; 702/34; 200/331
See application file for complete search history.

(56) References Cited

U.S. PATENT DOCUMENTS

| | | | | |
|---|---|---|---|---|
| 2,237,801 A | | 4/1941 | Williams | |
| 2,798,133 A | | 7/1957 | Curtis | |
| 2,834,856 A | | 5/1958 | Charewicz et al. | |
| 2,910,560 A | | 10/1959 | Stroup et al. | |
| 4,045,762 A | * | 8/1977 | Foulkes | H01H 31/127 337/401 |
| 4,268,811 A | * | 5/1981 | Evans | H01H 33/126 218/156 |
| 4,326,184 A | | 4/1982 | Murdock | |
| 4,414,527 A | * | 11/1983 | Biller | H01H 31/127 337/169 |
| 5,282,806 A | | 2/1994 | Haber et al. | |

(Continued)

OTHER PUBLICATIONS

International Search Report and Written Opinion for International Application No. PCT/US2020/028113 dated Jul. 16, 2020. (12 pages).

(Continued)

*Primary Examiner* — William A Bolton

(57) ABSTRACT

A guiding pull ring member for guiding a unit top contact in a switch assembly into a mounting contact. The guide ring member includes a mounting ring defined in a first plane, a grasping ring coupled to one side of the mounting ring and being defined in a second plane perpendicular to the first plane, and a V-shaped guide piece coupled to the mounting ring at a side opposite from the grasping ring and extending perpendicular to the first plane. The guiding pull ring member has particular application for a solenoid operated vacuum interrupter recloser switch mounted to a utility pole.

6 Claims, 2 Drawing Sheets

(56) References Cited

U.S. PATENT DOCUMENTS

| | | | | |
|---|---|---|---|---|
| 5,502,427 | A * | 3/1996 | Scherer | H01H 31/127<br>337/176 |
| 5,675,308 | A | 10/1997 | Scherer et al. | |
| 6,965,088 | B2 * | 11/2005 | Franklin | H01H 31/006<br>218/1 |
| 8,973,194 | B1 | 3/2015 | Caughey et al. | |
| 2009/0212898 | A1 * | 8/2009 | Montante | H01H 31/02<br>337/171 |
| 2012/0166103 | A1 | 6/2012 | Smith et al. | |
| 2015/0116878 | A1 | 4/2015 | Richard et al. | |

OTHER PUBLICATIONS

European Search Report for European Application No. 20790963.1 dated Dec. 13, 2022. (12 pages).

* cited by examiner

GUIDING PULL RING

CROSS-REFERENCE TO RELATED APPLICATION

This application claims the benefit of priority from the U.S. Provisional Application No. 62/835,621, filed on Apr. 18, 2019, the disclosure of which is hereby expressly incorporated herein by reference for all purposes.

BACKGROUND

Field

This disclosure relates generally to a guiding pull ring for handling a switch assembly and guiding a switch contact of the switch assembly into a mounting connector.

Discussion of the Related Art

An electrical power distribution network, often referred to as an electrical grid, typically includes a number of power generation plants each having a number of power generators, such as gas turbines, nuclear reactors, coal-fired generators, hydro-electric dams, etc. The power plants provide power at a variety of medium voltages that are then stepped up by transformers to a high voltage AC signal to be connected to high voltage transmission lines that deliver electrical power to a number of substations typically located within a community, where the voltage is stepped down to a medium voltage for distribution. The substations provide the medium voltage power to a number of three-phase feeder lines. The feeder lines are coupled to a number of lateral lines that provide the medium voltage to various distribution transformers, where the voltage is stepped down to a low voltage and is provided to a number of loads, such as homes, businesses, etc.

Power distribution networks of the type referred to above typically include a number of switching devices, breakers, reclosers, interrupters, etc. that control the flow of power throughout the network. A vacuum interrupter is a switch that has particular application for these types of devices. A vacuum interrupter employs opposing contacts, one fixed and one movable, positioned within a vacuum enclosure. When the interrupter is opened by moving the movable contact away from the fixed contact the arc that is created between the contacts is quickly extinguished by the vacuum. A vapor shield is provided around the contacts to contain the arcing. For certain applications, the vacuum interrupter is encapsulated in a solid insulation housing that has a grounded external surface. These types of vacuum interrupters are sometimes employed in single phase self-powered magnetically actuated reclosers, such as fault recloser switches.

Modern recloser switch assemblies are often releasably secured to contacts on a utility pole in a manner that allows a worker to install and remove the switch assembly to and from the pole using a hot stick from the ground. Installing recloser switch assemblies of this type includes positioning a bottom trunnion secured to the switch assembly into a mounting hinge mounted to the pole so that the switch assembly hangs from the hinge and is able to be rotated relative thereto. The worker then uses the hot stick to grab a pull ring at an opposite end of the switch assembly from the trunnion and rotate the switch assembly on the trunnion so that a unit top contact in the switch assembly engages a spring loaded mounting top contact that holds it in place and makes the electrical connection.

Opposing attachment hooks are provided in combination with the mounting top contact that provide a guide during a closing operation. However, because of a number of reasons, such as the length of the hot stick, the angle that the worker is able to access the switch assembly, play between the trunnion and the hinge, etc., the unit top contact is often misaligned with and is positioned outside of the attachment hooks so that the unit top contact engages and is held by the mounting contact, but does not make an electrical connection. In this situation, the unit top contact must be disengaged or unstuck from the mounting top contact using, for example, the hot stick and the pull ring and then reengaged with the mounting contact. However, if the unit top contact cannot be disengaged from the mounting contact in this manner when this occurs, the switch assembly must be taken down from the pole and fixed with much inconvenience and cost.

SUMMARY

The following discussion discloses and describes a guiding pull ring member for guiding a unit top contact in a switch assembly into a mounting contact. The guide ring member includes a mounting ring defined in a first plane, a grasping ring coupled to one side of the mounting ring and being defined in a second plane perpendicular to the first plane, and a V-shaped guide piece coupled to the mounting ring at a side opposite from the grasping ring and extending perpendicular to the first plane. In one non-limiting embodiment, the guiding pull ring member has application for a solenoid operated vacuum interrupter recloser switch mounted to a utility pole.

Additional features of the disclosure will become apparent from the following description and appended claims, taken in conjunction with the accompanying drawings.

DETAILED DESCRIPTION OF THE EMBODIMENTS

The following discussion of the embodiments of the disclosure directed to a guiding pull ring member including a V-shaped guide piece for guiding a unit top contact associated with a vacuum interrupter assembly into a mounting connector secured to a utility pole so as to make electrical contact therebetween is merely exemplary in nature, and is in no way intended to limit the disclosure or its applications or uses. For example, the discussion herein refers to the guiding pull ring member as being part of a fault recloser switch having a vacuum interrupter. However, as will be appreciated by those skilled in the art, the guiding pull ring member may have other applications.

Figure 1:
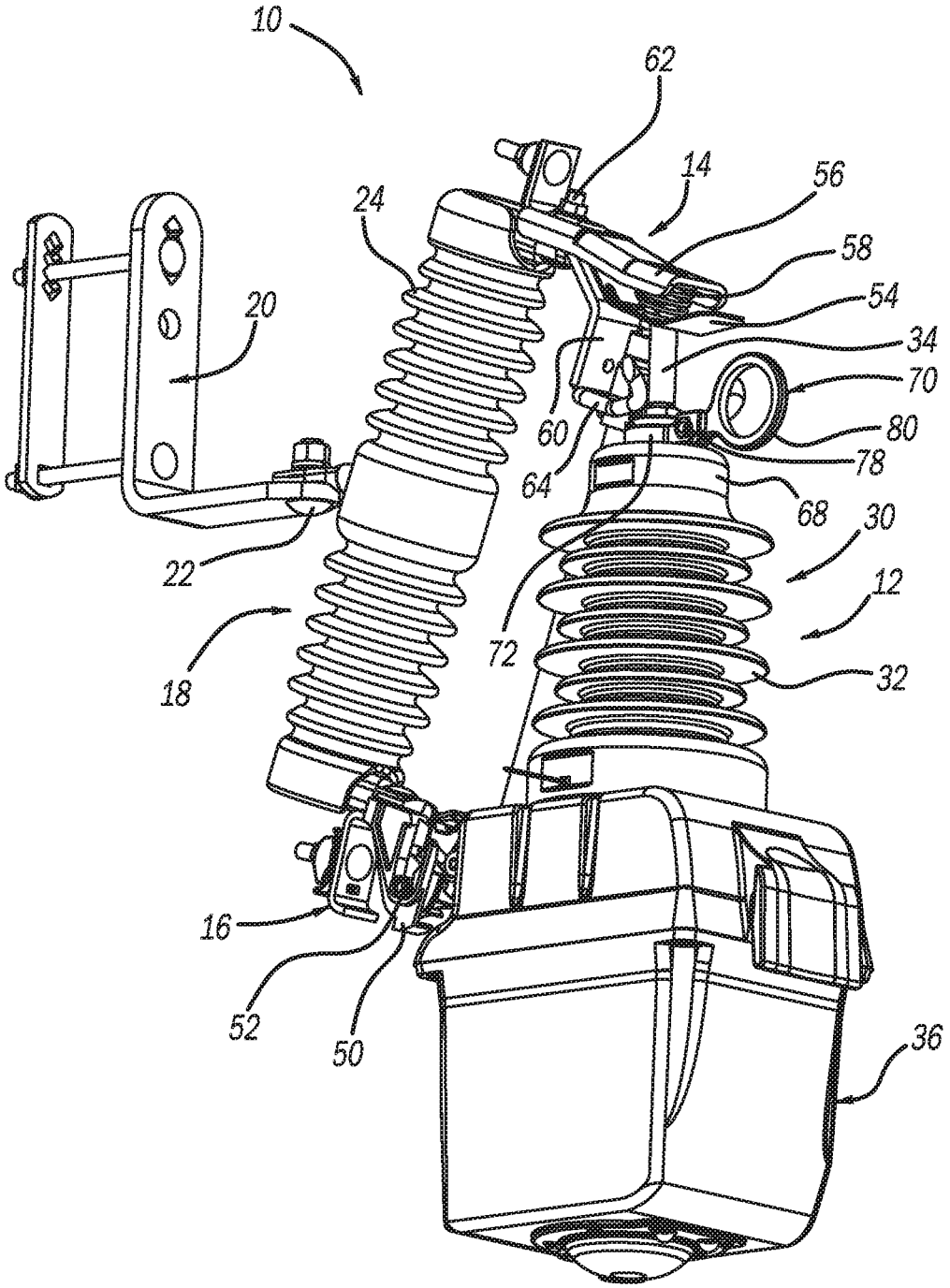
FIG. 1 is an isometric view of a solenoid operated vacuum interrupter assembly connected to an insulator, where the vacuum interrupter assembly includes a guiding pull ring member.

FIG. 1 is an isometric view of a switch assembly 10 including a solenoid operated vacuum interrupter assembly 12 coupled to a mounting assembly 14 and a mounting hinge 16. The mounting assembly 14 is secured to one end of an insulator 18 having skirts 24 and the mounting hinge 16 is secured to an opposite end of the insulator 18, where the insulator 18 is mounted to a bracket 20 by a bolt 22 and may be attached to a utility pole (not shown). In this non-limiting embodiment, the solenoid operated vacuum interrupter assembly 12 is a magnetically actuated recloser switch. Further, although the vacuum interrupter assembly 12 is shown and described herein as being mounted to a utility pole, it is noted that this is by way of a non-limiting example in that the vacuum interrupter assembly 12 may have application for other locations in a medium voltage power network, such as in a pad mounted switchgear.

The vacuum interrupter assembly 12 includes a vacuum interrupter 30 having an insulation housing 32 that encloses a vacuum interrupter switch (not shown) of the type referred to above, where the vacuum interrupter 30 can be any vacuum interrupter known in the art for medium voltage uses that is suitable for the purposes discussed herein. More particularly, the housing 32 encloses a vacuum chamber (not shown), a fixed contact (not shown) that is electrically coupled to a unit top contact 34, and a movable contact (not shown) that is electrically coupled to a unit bottom contact (not shown), where the fixed and movable contacts are in contact with each other within the vacuum chamber when the vacuum interrupter 30 is closed. When the vacuum interrupter 30 is opened by moving the movable contact away from the fixed contact the arc that is created between the contacts is quickly extinguished by the vacuum.

The housing 32 is mounted to an enclosure 36. In this non-limiting embodiment, the enclosure 36 encloses a dielectric drive rod (not shown) connected to the movable contact, a contact spring (not shown) and a solenoid or magnetic actuator (not shown). When the actuator is energized for a switch closing operation, the movable contact is forced against the fixed contact against the bias of the spring to hold the interrupter 30 closed through a magnetic latch in the actuator. When the actuator is energized for a switch open operation, the actuator and the spring move the movable contact away from the fixed contact to open the vacuum interrupter 30 and the actuator magnetically latches in the open position.

Figure 2:
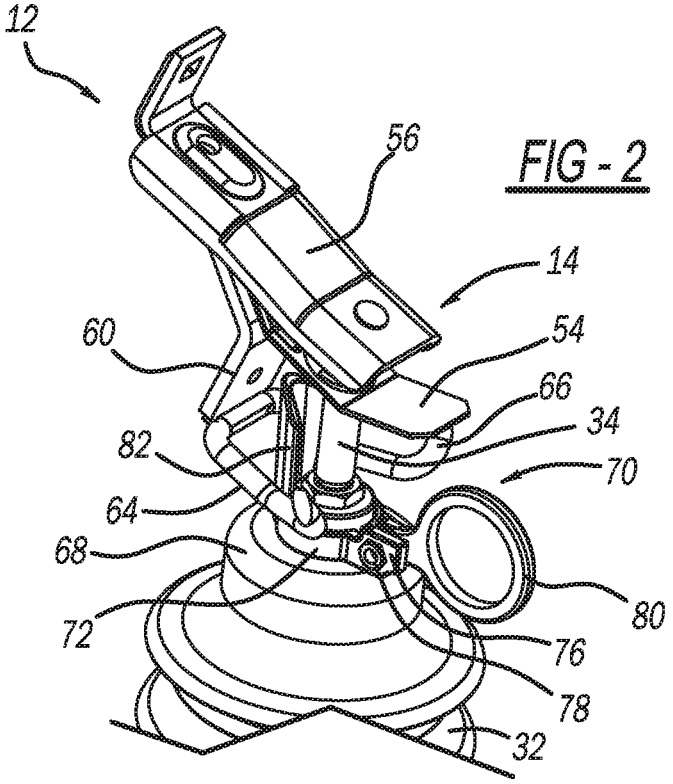
FIG. 2 is a broken-away isometric view of the vacuum interrupter assembly shown in FIG. 1 illustrating the guiding pull ring member including a guide piece.
Figure 3:
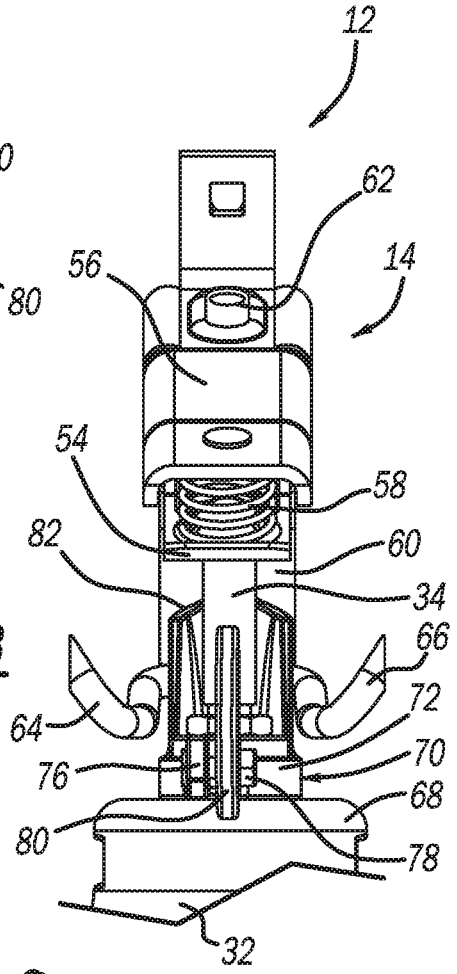
FIG. 3 is a broken-away front view of the vacuum interrupter assembly shown in FIG. 1 illustrating the guiding pull ring member including the guide piece.

FIG. 2 is a broken-away, isometric view and FIG. 3 is a broken-away, front view of the vacuum interrupter assembly 12 that better show the mounting assembly 14. The mounting hinge 16 includes a channel catch 50 that accepts a trunnion rod 52 coupled to the vacuum interrupter assembly 12 and that is electrically coupled to the unit bottom contact. The mounting assembly 14 includes a mounting top contact 54, an extension tab 56 and a spring 58 positioned between the contact 54 and the tab 56. The mounting assembly 14 also includes a support tab 60 bolted to the extension tab 56 by a bolt 62 and a pair of attachment hooks 64 and 66 coupled to and extending from the support tab 60 opposite to the extension tab 56.

Figure 4:
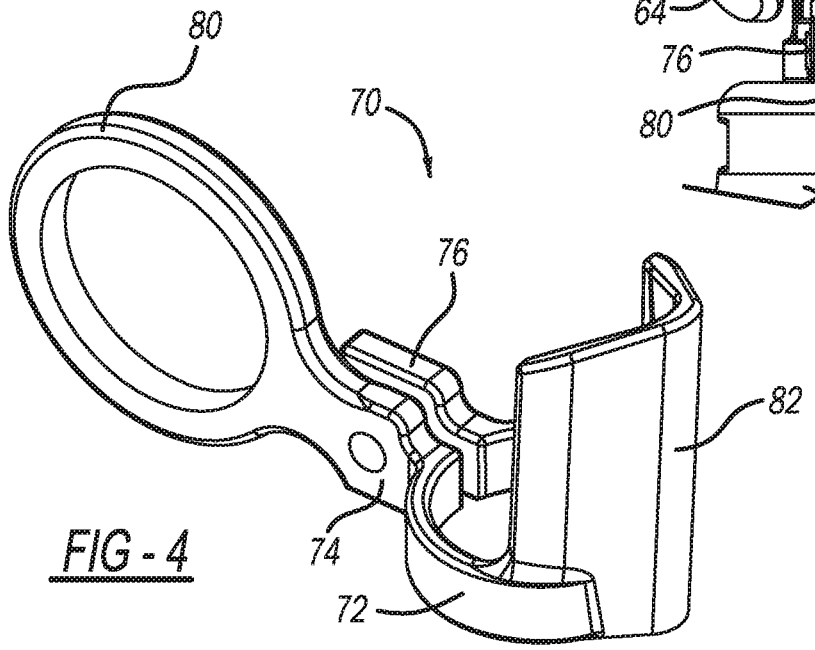
FIG. 4 is an isometric view of the guiding pull ring member separated from the vacuum interrupter assembly.

A guiding pull ring member 70 is coupled to a top insert 68 of the housing 32. FIG. 4 is an isometric view of the pull ring member 70 separated from the vacuum interrupter assembly 12. The pull ring member 70 includes an open mounting structure 72 (depicted as a ring although other open shapes may be employed) that is positioned around the top insert 68 and has opposing tabs 74 and 76, where the pull ring member 70 is clamped to the top insert 68 by a bolt 78 extending through the tabs 74 and 76. A grasping ring 80 is part of and extends from the tab 74 and is defined in a plane perpendicular to the plane of the mounting structure 72. A V-shaped guide piece 82 extends up from the mounting structure 72 generally in the same plane as the grasping ring 80 and opposite to the grasping ring 80 on the mounting ring 72. In one non-limiting embodiment, pull ring member 70 is a single-piece brass member and the guide piece 82 is about 2.5" tall.

To connect the vacuum interrupter assembly 12 to the insulator 18, a worker positions the trunnion 52 in the catch 50 using a hot stick or otherwise so that the vacuum interrupter assembly 12 hangs therefrom, where the vacuum interrupter assembly 12 is electrically coupled to the hinge 16. The worker then grasps the grasping ring 80 and rotates the vacuum interrupter assembly 12 so that the unit top contact 34 moves towards the mounting assembly 14. When the unit top contact 34 engages the mounting top contact 54 between the attachment hooks 64 and 66, the mounting top contact 54 is pushed upwards against the bias of the spring 58 towards the tab 56, where the unit top contact 34 is electrically and mechanically coupled to the mounting contact 54 and is held in place. Now there is an electrical path through the vacuum interrupter assembly 12. Because the guide piece 82 is positioned behind the unit top contact 34 it reaches the attachment hooks 64 and 66 before the contact 34 does. Because the guide piece 82 is V-shaped, it is able to more easily move between the attachment hooks 64 and 66 even if the unit top contact 34 is slightly misaligned with the attachment hooks 64 and 66. Therefore, the guide piece 82 increases the ability and reliability that the unit top contact 34 will be properly coupled to the mounting top contact 54. The worker can disconnect the vacuum interrupter assembly 12 from the insulator 18 by grasping the grasping ring 80 and pulling outward to disengage the contacts 34 and 54, and then lifting the trunnion 52 out of the catch 50.

The foregoing discussion discloses and describes merely exemplary embodiments of the present disclosure. One skilled in the art will readily recognize from such discussion and from the accompanying drawings and claims that various changes, modifications and variations can be made therein without departing from the spirit and scope of the disclosure as defined in the following claims.

What is claimed is:

1. A vacuum interrupter switch assembly comprising:

a vacuum interrupter disposed within a housing, the housing having a top surface formed with an standoff;

a contact that extends from the standoff and parallel to a longitudinal axis of the housing, the contact configured to electrically connect the vacuum interrupter within the housing to a contact of a mounting into which the vacuum interrupter switch assembly is configured to be disposed;

a guide and pull ring structure including a mounting ring sized to be received around and mechanically secured to the standoff, a grasping ring coupled to one side of the mounting ring and being defined in a second plane perpendicular to a first plane and parallel to the longitudinal axis, and a V-shaped guide piece coupled to the mounting ring at a side opposite from the grasping ring and extending perpendicular to the first plane and parallel to the longitudinal axis, an open side of the V-shaped guide piece being aligned toward and parallel to the contact and a closed side of the V-shaped guide piece, opposite the open side, being aligned away from and parallel to the contact when the mounting ring is secured to the standoff.

2. The vacuum interrupter switch assembly of claim 1, wherein the standoff is cylindrical.

3. The vacuum interrupter switch assembly of claim 1, wherein the vacuum interrupter switch assembly is a recloser switch configured to be mounted to a utility pole.

4. The vacuum interrupter switch assembly of claim 1, wherein the V-shaped member and the contact above a top surface of the standoff have a common length dimension.

5. The vacuum interrupter switch assembly of claim 4, wherein the grasping ring is coupled to one of a securing tabs.

6. The vacuum interrupter switch assembly of claim 1, wherein the mounting ring is an open ring and includes a pair of opposing securing tabs that operate to close the mounting ring about the standoff.

* * * * *